US007710011B2

(12) United States Patent
Chang et al.

(10) Patent No.: US 7,710,011 B2
(45) Date of Patent: May 4, 2010

(54) FLAT LIGHT SOURCE

(75) Inventors: Chao-Jen Chang, Taoyuan County (TW); Chu-Chi Ting, Hualien County (TW); Su-Chiu Lee, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 673 days.

(21) Appl. No.: 11/306,104

(22) Filed: Dec. 16, 2005

(65) Prior Publication Data

US 2007/0138935 A1 Jun. 21, 2007

(51) Int. Cl.
*H01J 1/62* (2006.01)
*H01J 63/04* (2006.01)

(52) U.S. Cl. ..... 313/493; 313/483; 313/484; 313/489; 313/491; 313/494

(58) Field of Classification Search ..... 313/483–493
See application file for complete search history.

(56) References Cited

U.S. PATENT DOCUMENTS

2002/0079827 A1* 6/2002 Park ..... 313/485
2006/0006805 A1* 1/2006 Son et al. ..... 313/607

FOREIGN PATENT DOCUMENTS

JP 2002-075223 3/2002
JP 2002298743 10/2002
JP 2003-203573 7/2003
JP 2004241379 8/2004

OTHER PUBLICATIONS

"Office Action of Japan counterpart application", issued on Nov. 6, 2009, p. 1-p. 2.

* cited by examiner

*Primary Examiner*—Peter J Macchiarolo
*Assistant Examiner*—Thomas A Hollweg
(74) *Attorney, Agent, or Firm*—Jianq Chyun IP Office

(57) ABSTRACT

A flat light source including a first substrate, a second substrate, a sealant, several sets of dielectric pattern and a phosphor layer is provided. The first substrate has electrodes thereon. The sealant is disposed between the first and second substrates to form a space between the first and second substrates and the sealant. These sets of dielectric pattern are formed in the space between the first and second substrates. Each set of dielectric pattern has at least two dielectric strips, and each dielectric strip covers one of the electrodes correspondingly. Each dielectric strip has a top surface and two side surfaces, and the top surface has an uneven contour. The phosphor layer is disposed between the two dielectric strips of each set of dielectric pattern, and the phosphor layer is further disposed on the top surface of the dielectric strips.

7 Claims, 3 Drawing Sheets

FLAT LIGHT SOURCE

BACKGROUND OF THE INVENTION

1. Field of Invention

The present invention relates to a flat light source and fabricating method thereof. More particularly, the present invention relates to a flat light source having high brightness and fabricating method thereof.

2. Description of Related Art

In recent years, the Liquid Crystal Display panel (LCD panel) plays a predominant role in the display screen. However, since the LCD panel itself is incapable of emitting light, a back light module must be disposed below the LCD panel to provide a light source, thus achieving a display function. The light source of the back light module is usually provided by the lamp. After passing through the optical film of the back light module and then being scattered, the light emitted by the lamp forms a surface light source suitable for irradiating the LCD panel.

But if the flat light source can be used directly, the light application efficiency and the uniformity of surface light source may be improved. Moreover, the flat light source can be used in other various fields, besides in the back light source of the LCD panel. Therefore, the flat light source has the advantages in development.

Generally, the flat light source is a plasma light-emitting device, mainly applying a high voltage difference between the electrode pair to produce the energetic electrons, and then to form the so-called plasma by the energetic electrons bombarding the inert gas. And then, the excited atoms in the plasma will release energy by way of radiating UV light, while the UV light radiated will further excites the phosphor of the flat light source to emit the visible light.

It has become one key of the active development for the existing flat light source, that how to enhance the brightness, and improve the uniformity of light emitting.

SUMMARY OF THE INVENTION

Accordingly, an objective of the present invention is to provide a flat light source, which has high brightness and high light emitting uniformity.

Another object of the present invention is to provide a method for fabricating the flat light source, and the fabricated flat light source has high brightness and high light emitting uniformity.

The present invention provides a flat light source, which includes a first substrate, a second substrate, a sealant, several sets of dielectric pattern and a phosphor layer. The first substrate has electrodes thereon. The sealant is disposed between the first and second substrates to form a space between the first and second substrates and the sealant. These sets of dielectric pattern are formed in the space between the first and second substrates. Each set of dielectric pattern has at least two dielectric strips, and each dielectric strip covers one of the electrodes correspondingly. Each dielectric strip has a top surface and two side surfaces, and the top surface has an uneven contour. The phosphor layer is disposed between the dielectric strips of each set of dielectric pattern, and the phosphor layer is further disposed on the top surface of the dielectric strips.

In one embodiment of the present invention, the phosphor layer described above is further disposed between the two adjacent sets of dielectric pattern.

In one embodiment of the present invention, the flat light source further comprises several spacers disposed in the space between the first and second substrates. In one embodiment, the phosphor layer is further coated onto the surfaces of the spacers. In another embodiment, the height of the dielectric strips is the same as that of the spacers. In yet another embodiment, the height of the dielectric strips is less than that of the spacers.

In one embodiment of the present invention, the height of the dielectric strips is the same as the gap between the first and second substrates.

In one embodiment of the present invention, the flat light source further comprises a reflective layer disposed on the surface of the first substrate.

In one embodiment of the present invention, the flat light source further comprises another phosphor layer disposed on the second substrate.

The present invention further provides a method for fabricating a flat light source. In this method, a first substrate is provided. Then, several electrodes are formed on the first substrate. And then several sets of dielectric pattern are formed on the first substrate. Each set of dielectric pattern has at least two dielectric strips, and each dielectric strip covers one of the electrodes correspondingly, wherein each of the formed dielectric strips has a top surface and two side surfaces, and the top surface has an uneven contour. Subsequently, a phosphor layer is formed between the dielectric strips of each set of dielectric pattern and on the top surface of the dielectric strips. A second substrate is provided, and a sealant is formed between the first and second substrates to bond the first and second substrates together.

In one embodiment of the present invention, the method for forming the dielectric strips comprise a screen-printing process, an etching process or a sandblasting process.

In one embodiment of the present invention, the step of forming the phosphor layer further comprises coating the phosphor layer between the adjacent sets of the dielectric pattern.

In one embodiment of the present invention, the method further comprises forming several spacers between the first and second substrates before bonding the first and second substrates. In one embodiment, the phosphor layer is further coated onto the surfaces of the spacers. In another embodiment, the height of the dielectric strips is the same as that of the spacers. In yet another embodiment, the height of the dielectric strips is less than that of the spacers.

In one embodiment of the present invention, the height of the above mentioned dielectric strips is the same as the gap between the first and second substrates.

In one embodiment of the present invention, the method further comprises forming a reflective layer on the first substrate, before forming the electrodes on the first substrate.

In one embodiment of the present invention, the method further comprises forming another phosphor layer on the second substrate.

Since the top surface of each dielectric strip is designed to be an uneven contour, the coating area of the phosphor layer may be increased, thus improving the brightness of the flat light source.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
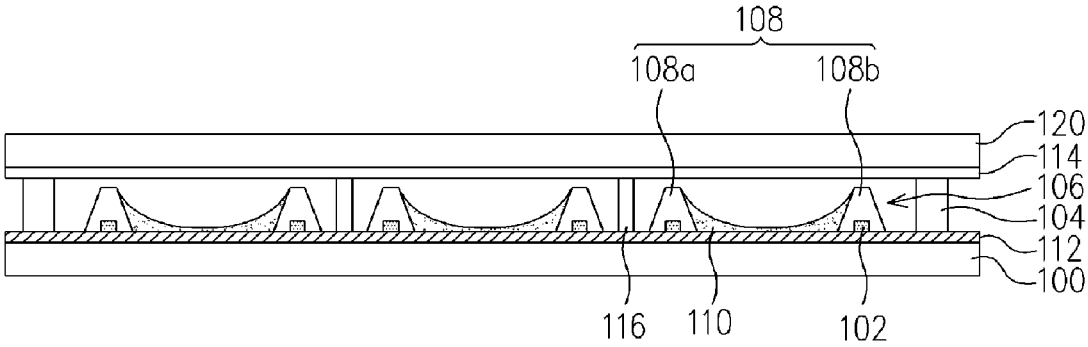
FIGS. 1A to 1C are schematic sectional views of the flat light source according to several embodiments of the present invention.

FIG. 1A is a schematic sectional view of the flat light source according to a preferred embodiment of the present invention. Referring to FIG. 1A, the flat light source of the present invention includes a first substrate 100, a second substrate 120, a sealant 104, several electrodes 102, several sets of dielectric pattern 108 and a phosphor layer 110.

The electrodes 102 are disposed on the first substrate 100. Each of the electrodes 102 is in a strip shape and these electrodes 102 are disposed on the first substrate 100 parallel to each other. The sealant 104 is disposed between the first and second substrates 100, 120 to form a space 106 between the first and second substrates 100, 120 and the sealant 104. The sealant 104 is used to bond the first and second substrates 100,120 together, and leave a gap between the two substrates 100, 120. The dielectric pattern 108 is disposed on the first substrate 100 and in the space 106. Each set of dielectric pattern 108 has at least two dielectric strips 108*a*, 108*b*, and each of the dielectric strips 108*a*, 108*b* covers one of the electrodes 102 correspondingly. Therefore, the two electrodes 102 covered by the two dielectric strips 108*a*, 108*b* of a set of dielectric pattern 108 are an electrode pair.

Figure 4:
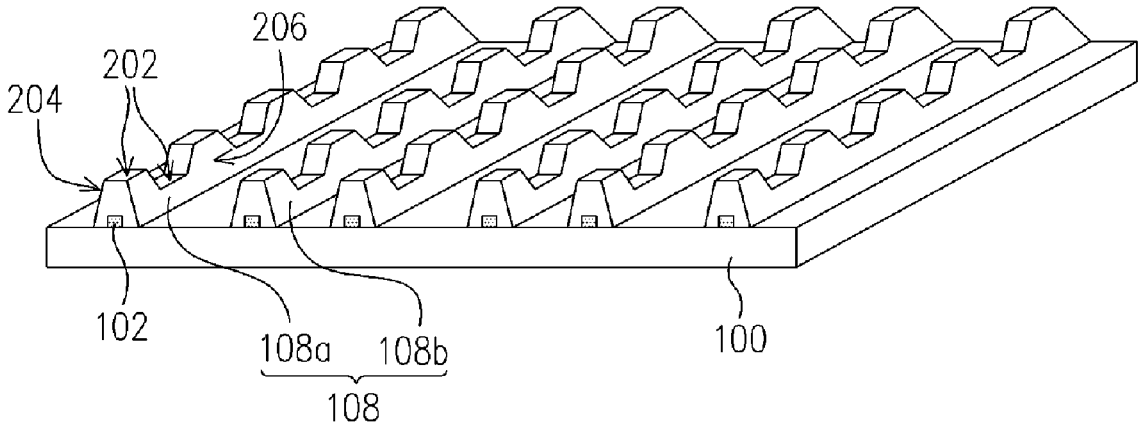
FIG. 4 is a three-dimensional schematic view of the dielectric pattern of the flat light source according to a preferred embodiment of the present invention.

Particularly, the dielectric strips 108*a*, 108*b* of the present invention have special contours. Referring to FIG. 4, it depicts a three-dimensional schematic view of several sets of dielectric pattern 108 on the first substrate 100. Each of the dielectric strips 108*a*, 108*b* has a top surface 202 and two side surfaces 204, 206, and the top surface 202 has an uneven contour. In other words, each of the dielectric strips 108*a*, 108*b* has a protruding portion and a recessing portion, thus forming an uneven structure or a stepped structure.

Figure 5:
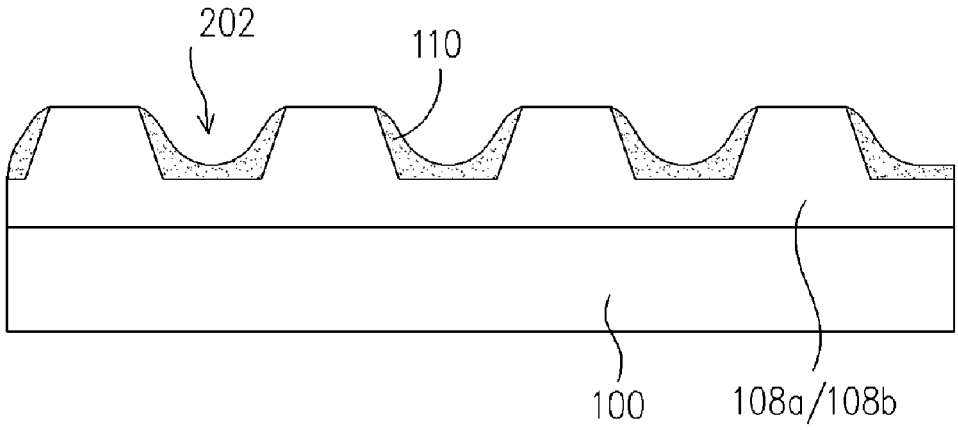
FIG. 5 is a sectional view of one of the dielectric strips of the flat light source along its extending direction according to a preferred embodiment of the present invention.

Moreover, referring to FIG. 1A, the phosphor layer 110 is disposed between the two dielectric strips 108*a*, 108*b* of each set of dielectric pattern 108, and the phosphor layer 110 is further disposed on the top surface 202 of the dielectric strips 108*a*, 108*b*, in which the top surface 202 is uneven contour. As shown in FIG. 5, it is a sectional view of the dielectric strips 108*a* or 108*b* along its extending direction. The phosphor layer 110 is further coated onto the top surface 202 of the dielectric strip 108*a* or 108*b*.

According to another embodiment of the present invention, a reflective layer 112 is further disposed on the first substrate 100. The reflective layer 112 may be disposed on the top surface of the first substrate 100, and the electrodes 102 are disposed on the reflective layer 112. The reflective layer 112 may also be disposed under the bottom surface of the first substrate 100 (not shown). No matter the reflective layer 112 is disposed on the top surface of the first substrate 100 or under the bottom surface of the first substrate 100, the reflective layer 112 can be made of nonconductive material.

According to one embodiment of the present invention, a phosphor layer 114 can be further disposed on the second substrate 120. Thus, the area coated by the phosphor layer in the flat light source may be further increased.

The phosphor layer 110 in the flat light source of the present invention is not only coated between the two dielectric strips 108*a* and 108*b*, but also coated to the top surface 202 of the dielectric strips 108*a*,108*b*, in which the top surface 202 has an uneven contour. Therefore, compared with the conventional flat light source, the area coated by the phosphor layer in the flat light source of the present invention is larger, and the cross-talking phenomenon may occur at the recessing portion of the dielectric strips 108*a*, 108*b*, so that the portion incapable of emitting light before may emit light because of cross-taking phenomenon. Thus, the brightness of the flat light source may be improved.

Figure 1B:
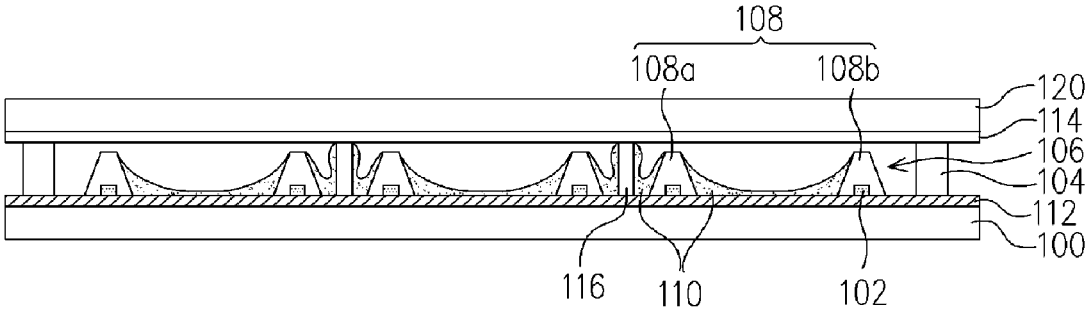

According to a preferred embodiment of the present invention, as shown in FIG. 1A, the flat light source may further comprises several spacers 116 disposed in the space 106 between the first and second substrates 100, 120 for maintaining the height of the gap between the first and second substrates 100, 120. In another preferred embodiment of the present invention, the phosphor layer 110 described above is further coated onto the surfaces of the spacers 116, as shown in FIG. 1B. Thus, the area coated by the phosphor layer is further increased, and thereby the brightness and light emitting uniformity of the flat light source may be improved.

Figure 1C:
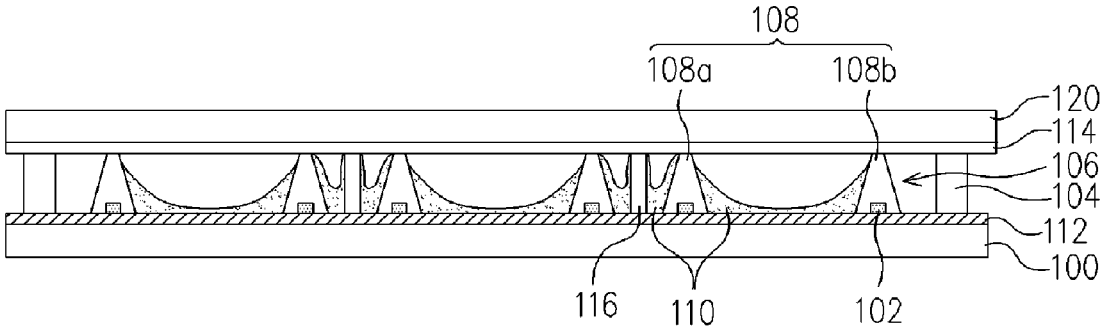

If spacers 116 (as shown in FIGS. 1A and 1B) are included in the flat light source, the height of the dielectric pattern 108 may be less than that of the spacers 116. Definitely, the height of the dielectric pattern 108 can also be the same as that of the spacers 116, as shown in FIG. 1C. Thus, the spacers 116 and the dielectric pattern 108 may support the two substrates 100,120 to maintain the height of the gap between the two substrates 100, 120.

Figure 2:
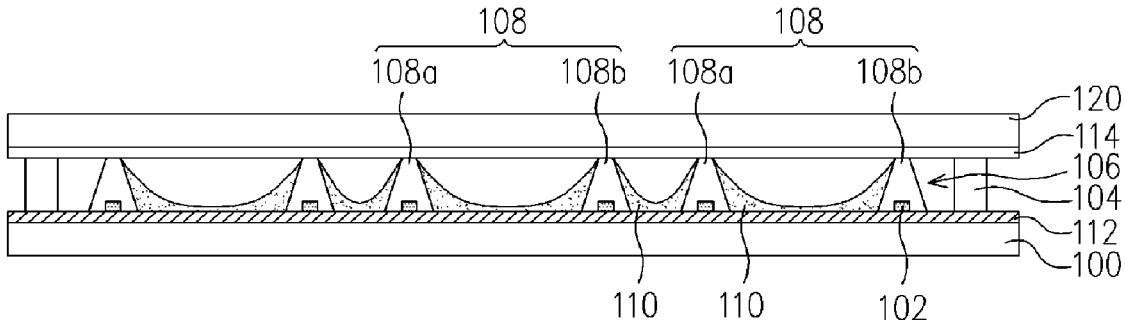
FIG. 2 is a schematic sectional view of the flat light source according to another embodiment of the present invention.

However, the present invention is not limited to that the spacers must be disposed in the flat light source. In another embodiment of the present invention, the spacers are not included in the flat light source, as shown in FIG. 2. Since the spacers are not included in the flat light source, the height of the set of dielectric pattern 108 is preferably the same as that of the spacers 116 so as to maintain the height of the gap between the two substrates 100, 120. While in the embodiment of FIG. 2, the phosphor layer 110 is not only coated between the two dielectric strips 108*a* and 108*b* of each set of dielectric pattern 108 and on the uneven contoured top surface of the dielectric strips 108*a*, 108*b*, but also coated between the two adjacent sets of dielectric pattern 108. Thus, the area coated by the phosphor layer is further increased, and thereby the brightness of the flat light source is enhanced.

Figure 3:
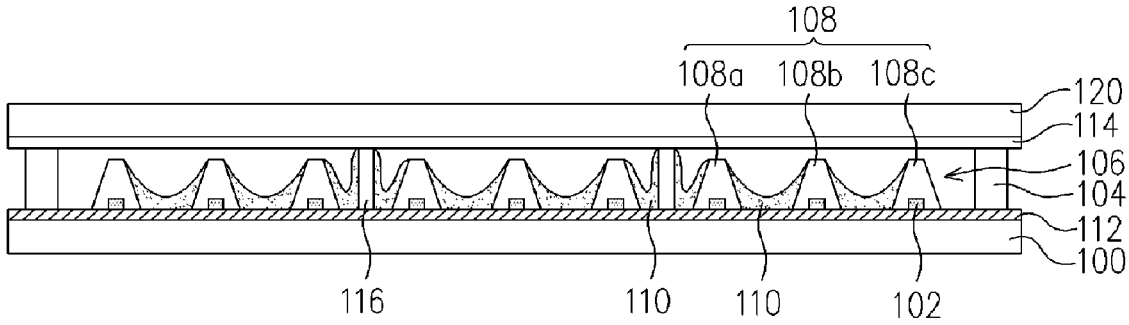
FIG. 3 is a schematic sectional view of the flat light source according to yet another embodiment of the present invention.

In the embodiments of FIGS. 1A to 1C and FIG. 2 described above, each set of dielectric pattern 108 has two dielectric strips 108*a*, 108*b* (an electrode pair), but the present invention is not limited to this. The flat light source structure of the present invention can also be that each set of dielectric pattern 108 has three or more dielectric strips 108*a*, 108*b* and 108*c* (and three electrodes 102), as shown in FIG. 3. In particularly, the contour of the top surface of the dielectric strips 108*a*, 108*b* and 108*c* is uneven, and the phosphor layer 110 does not only cover between the dielectric strips 108*a*, 108*b* and 108*c*, but also cover the top surface of the dielectric strips 108*a*, 108*b* and 108*c*. While if the spacer 106 is further included in the flat light source, the phosphor layer 110 further covers on the surfaces of the spacers 116.

The method for fabricating the flat light source described above is illustrated as follows. First, referring to FIG. 1A, 1B or 1C, a first substrate 100 is provided. And then several electrodes 102 are formed on the first substrate 100 by known methods, such as deposition and etching process or screen-printing process. In one embodiment, the method further comprises forming a reflective layer 112 on the first substrate 100.

Subsequently, several sets of dielectric pattern 108 are formed on the first substrate, wherein each set of dielectric pattern 108 has at least two dielectric strips 108*a* and 108*b*, and each of the dielectric strips 108*a*, 108*b* covers one of the electrodes 102 correspondingly. Particularly, each of the formed dielectric strips 108*a*, 108*b* has a top surface 202 and two side surfaces 204, 206, and the top surface 202 has an uneven contour, as shown in FIG. 4. The methods for forming the dielectric strips 108*a*, 108*b* comprise a screen-printing process, an etching process or a sandblasting process.

After that, a phosphor layer 110 is formed between the dielectric strips 108*a* and 108*b* of each set of dielectric pattern 108, and the phosphor layer 110 is further coated on the top surface 202 of the dielectric strips 108*a*, 108*b* (as shown in FIG. 5). And then, a second substrate 120 is provided. In a preferred embodiment, another phosphor layer 114 is further formed on the second substrate 120. A sealant 104 is formed between the first and second substrates 100 and 120, and the first and second substrates 100, 120 are bonded together to form a space 106 between the first and second substrates 100, 120 and the sealant 104. Afterward, the inert gas is filled into the space 106. When the power supply is on, the energetic electrons produced between the electrodes 102 may bombard the inert gas, thus forming the plasma.

According to the preferred embodiment, before bonding the substrates 100 and 120, and more particularly, before coating the phosphor layer 110, the method further comprises forming the spacers 116 on the first substrate 100 or the second substrate 120. If the spacers 116 are formed in the flat light source, and more preferably, the phosphor layer 110 is further coated onto the surfaces of the spacers 116 during the process of coating the phosphor layer 110. If the spacers are not formed in the flat light source, the phosphor layer 110 is further coated between the two adjacent sets of the dielectric pattern 108 during the process of coating the phosphor layer 110, as shown in FIG. 2.

In view of the above, in the flat light source and fabricating method thereof of the present invention, since the formed dielectric strips have a top surface with an uneven contour, and the phosphor layer is not only coated between the two dielectric strips, but also coated on the uneven contoured top surface of the dielectric strips. Therefore, compared with the conventional flat light source, the area coated by the phosphor layer in the flat light source of the present invention is larger, and the cross-talking phenomenon may occur at the recessing portion of the dielectric strips, so that this portion incapable of emitting light before may emit light because of cross-talking phenomenon. Thus, the brightness of the flat light source may be improved.

Additionally, the phosphor layer is coated on other locations which are not coated with phosphor layer in the prior art, such as the surfaces of the spacers or between the two adjacent sets of dielectric pattern. Thus, the area coated by the phosphor layer may be increased, and thereby the brightness of the flat light source may be enhanced. Furthermore, the overall light emitting uniformity of the flat light source will be improved.

The present invention has been disclosed above in the preferred embodiments, but is not limited to those. It is known to persons skilled in the art that some modifications and innovations may be made without departing from the spirit and scope of the present invention. Therefore, the scope of the present invention should be defined by the following claims.

What is claimed is:

1. A flat light source, comprising:

a first substrate having a planar surface and a plurality of electrodes disposed on the planar surface, wherein the first substrate has no groove on the planar surface thereof;

a second substrate;

a sealant disposed between the first and second substrates to form a space between the planar surface of the first substrate, second substrates and the sealant;

a plurality of sets of dielectric pattern formed in the space between the first and second substrates, each set of dielectric pattern having at least two dielectric strips, and each dielectric strip covering one of the electrodes correspondingly, wherein each dielectric strip has a top surface and two side surfaces, and the top surface has an uneven contour;

a phosphor layer disposed between the dielectric strips of each set of dielectric pattern, wherein the phosphor layer is further disposed on the top surface of the dielectric strips; and a plurality of spacers disposed in the space between the first and second substrates, wherein the height of the dielectric strips is the same as that of the spacers.

2. The flat light source as claimed in claim 1, wherein the phosphor layer is further disposed between the adjacent sets of the dielectric pattern.

3. The flat light source as claimed in claim 1, wherein the phosphor layer is further coated onto the surfaces of the spacers.

4. The flat light source as claimed in claim 1, wherein the height of the dielectric strips is less than that of the spacers.

5. The flat light source as claimed in claim 1, wherein the height of the dielectric strips is the same as the gap between the first and second substrates.

6. The flat light source as claimed in claim 1 further comprising a reflective layer disposed on the surface of the first substrate.

7. The flat light source as claimed in claim 1, further comprising another phosphor layer disposed on the second substrate.

* * * * *